United States Patent [19]

Auras

[11] 4,401,047

[45] Aug. 30, 1983

[54] WIND-PROPELLED CRAFT

[76] Inventor: Alain G. Auras, 4011 Taos Dr., San Diego, Calif. 92117

[21] Appl. No.: 226,374

[22] Filed: Jan. 19, 1981

[51] Int. Cl.[3] ..... B63H 9/04; B63B 1/12; B63B 41/00

[52] U.S. Cl. ..... 114/39; 114/61; 114/136

[58] Field of Search ..... 403/76, 90, 114, 122; 9/310 R, 310 B, 310 C, 310 E, 310 D; 441/65, 68, 70, 73, 76, 77; 114/39, 56, 61, 89, 90, 91, 93, 132–134, 136, 143

[56] References Cited

U.S. PATENT DOCUMENTS

| | | | |
|---|---|---|---|
| 2,746,700 | 5/1956 | Barbera | 403/90 |
| 3,116,708 | 1/1964 | Gardhouse | 114/61 |
| 3,264,663 | 9/1966 | Owens | 9/310 C |
| 3,273,528 | 9/1966 | Kiefer | 114/61 |
| 3,326,166 | 6/1967 | Yost | 114/283 |
| 3,479,980 | 11/1969 | Simmons | 114/283 |
| 3,487,800 | 1/1970 | Schweitzer | 114/91 |
| 3,509,842 | 5/1970 | Mitchell | 114/61 |
| 3,566,819 | 3/1971 | Keddie | 114/61 |
| 3,870,004 | 3/1975 | Bailey | 114/39 |

*Primary Examiner*—Sherman D. Basinger
*Assistant Examiner*—Rodney A. Corl
*Attorney, Agent, or Firm*—Henri J. A. Charmasson

[57] ABSTRACT

A wind-propelled craft having at least two elongated, low-profiled, flat-bottomed floats. The floats are parallelly and distally connected by a framework adapted to support the wind propulsion structure. The framework and floats are connected by fore and aft articulated joints which allow for arcuate travel of the framework and propulsion means relative to trim while maintaining level positioning of the flat-bottomed floats in relation to the medium being traversed. The floats, therefore, do not heel into the water. Resistance to the craft's speed and manueverability is thus diminished because the craft planes upon the water rather than heeling into it as is the case with conventional hulls and float assemblies.

1 Claim, 8 Drawing Figures

WIND-PROPELLED CRAFT

BACKGROUND AND SUMMARY OF THE INVENTION

Prior art wind-propelled crafts have utilized conventional hulls, most often structured in a general U-shape with a hollow interior. The lowermost portions of these hulls are immersed in water and provide flotation means for the craft. When the craft is under way, a certain amount of heel or cant is experienced by the hulls which are integral with a supporting framework or superstructure. Depending upon the angle of heel, the hulls penetrate the water obliquely and therefore experience a greater water resistance factor relative, of course, to the angle of heel. Even when the craft is running with the wind, i.e., the conventional U-shaped hulls are level in the water and the wind is coming from aft, the hull configuration is cumbersome and still penetrate the water below the water line.

The instant invention has overcome the resistance problem in two specific ways. The first is the provision of flat-bottomed floats which plane upon the water. The second is the provision of articulated joints fore and aft in the floats which connect with a framework which is structured to hold conventional sails and rigging. When the craft heels to wind force, the floats remain level by virtue of fore and aft articulated joints comprised of a bushing in the float itself, an expanded head end to fit into the bushing, a leg which is integral with the head, the leg being integral with the structural framework. This framework/float juncture allows the craft to heel while the floats remain level. The floats, therefore, plane easily over the water, a minimum of penetration into the water being achieved, and the greatest possible diminution of water resistance is accomplished. Stabilization of the craft is achieved by anti-slippage means which project from the bottom of the respective floats medially or amidships of the craft. Yet another advantage of the craft is a hydrofoil or lifting effect caused by the slanted position of the rudders under heel conditions while the float remains horizontal. The lift decreases the submerged area of the craft and allows for even greater speed to be accomplished.

DETAILED DESCRIPTION OF THE PREFERRED EMBODIMENT

Figure 1:
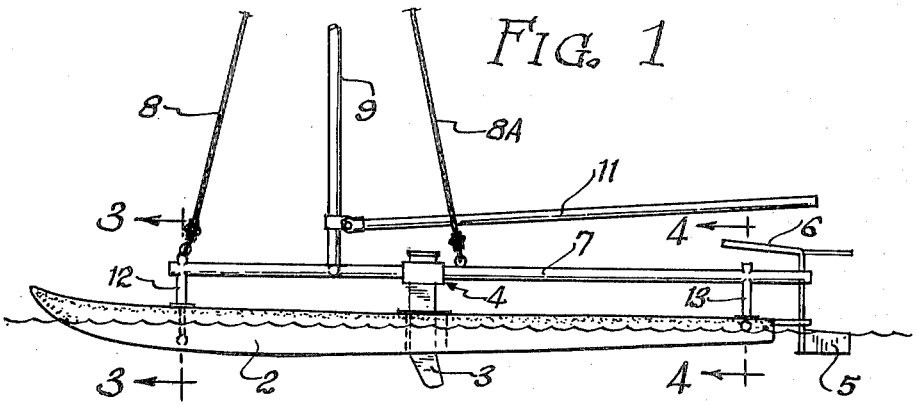
FIG. 1 is a side elevation view showing a wind-propelled craft and float configuration.

Referring now to the drawing, a side view is shown in FIG. 1 of a wind-propelled craft illustrating the flatened, elongated configuration of a float 2. Anti-slippage means (i.e., a daggerboard or fin), 3 passes through float 2 medially and projects from the bottom and top thereof. An anti-slippage means securing assembly is shown generally at 4, as will be more fully described. Rudder 5 effects guidance of the craft through the water in cooperation with a tiller 6. Shrouds 8, 8A converge from mast 9 to fixedly attach to the forward portion of framework 7 and medial portion of framework 7, respectively, to steady the mast against lateral sway. Framework 7 has a pair of legs 12 which articulately seat in float 2 in the forward portion; and a pair of legs 13, longer than legs 12, due to shallowness of the float's dimension in the aft portion, which also articulately seat in the float 2. Boom 11 is secured to mast 9 and pivots in a horizontal plane as a function of the craft's trim.

Figure 2:
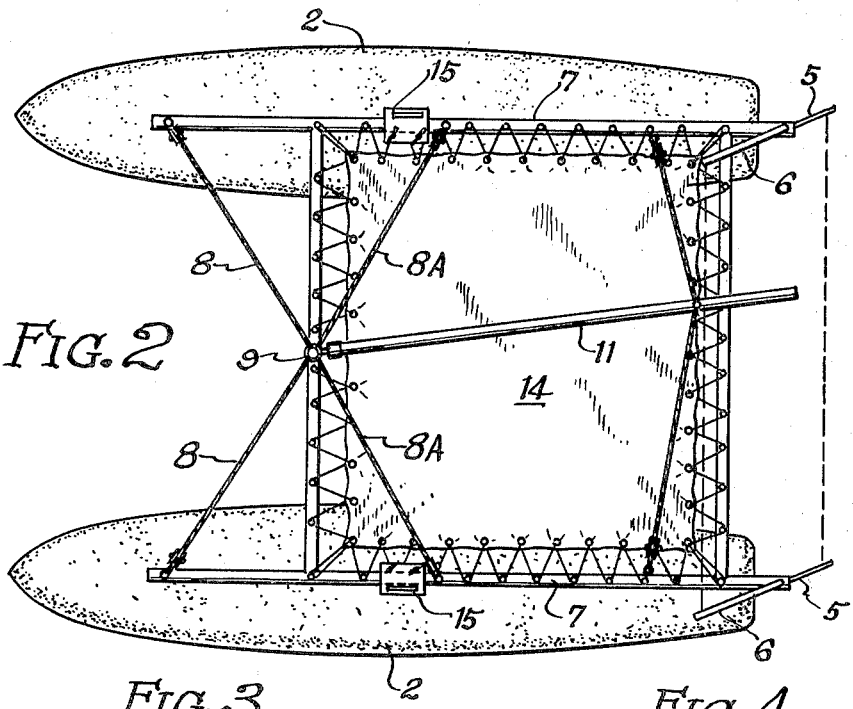
FIG. 2 is a top plan view showing the craft's overall structure relative to a pair of flat-bottomed floats and supporting framework.

The top plan view of FIG. 2 more clearly illustrates the relationship of floats to framework. It can be seen that a bilateral symmetry exists relative to floats, anti-slippage means, shrouds, rubbers and rigging. A trampoline 14 lies within framework 7 for supporting a user or users of the craft. Anti-slippage means wells 15 are easily accessible to the user in view of their proximity to trampoline 14. Rudders 5 are responsive to a tiller (not shown) for purposes of steering the craft. Shrouds 8, 8A can be seen to emerge from the top of mast 9 and fixedly attach to the forward portion of framework 7 and amidships proximal to anti-slippage means wells 15, respectively. The boundaries of framework 7 are clearly defined in this view and entirely encompass trampoline 14.

Figure 3:
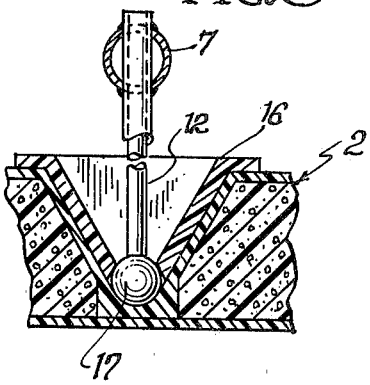
FIG. 3 is a cross-sectional detail taken across line 3—3 of FIG. 1 of an articulated joint assembly.

Referring now to FIG. 3, an aft joint assembly is shown in cross-section. Leg 13 seats within bushing 16 seated in float 2 (partially shown); a V-shaped housing is formed by bushing 16 and an expanded, rounded head end 17 allows pivotal movement of the leg 13 about multiple axes, as far as the angular border of bushing 16 will permit. The pivotal movement of legs 13 in relation to floats 2 about the longitudinal (fore-and-aft) axis allows one of the floats to remain level on the water line when the framework and superstructure heels under the wind. The pivotal movement of the legs 13 about a transversal, horizontal axis accommodates flexural movements of the floats without straining the framework. This last feature allows for use of soft and pliable floats built around light structural elements, or even inflatable, buoyant elements, without solid infrastructure. It should also be noted that the aft legs of the framework may differ in length from the fore ones and may be articulated at different levels as dictated by the geometry of the float.

Figure 4:
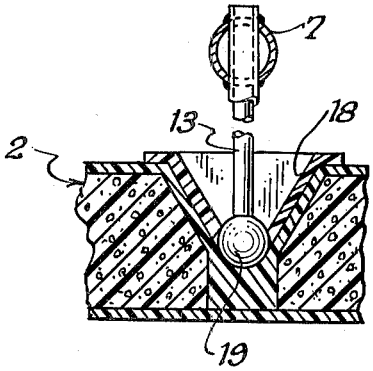
FIG. 4 is a cross-sectional taken across line 4—4 of FIG. 1 of yet another articulated joint assembly.

FIG. 4 is the forward joint assembly, also shown in cross-section. It can easily be seen that the leg is shorter than leg 13 of FIG. 3 due to variation in geometry between the fore and aft portions of the float 2. Leg 12 seats within bushing 18 and an expanded, rounded head end 19 allows pivotal movement of leg 12 about multiple axes, as far as the angular border of bushing 18 will permit.

It should be noted that both articulated joints of FIGS. 3 and 4 seat proximal to the water line. This feature allows for maximum leveling of the floats under heel conditions and enhances the plane effect vis-a-vis water/float relationship. Furthermore, the pivotal point of the articulated joints must be as close as possible to the bottom skin of floats 2 in order to keep the lower part of the channel open to the water, i.e., as narrow as possible, thus reducing turbulence.

Figure 5:
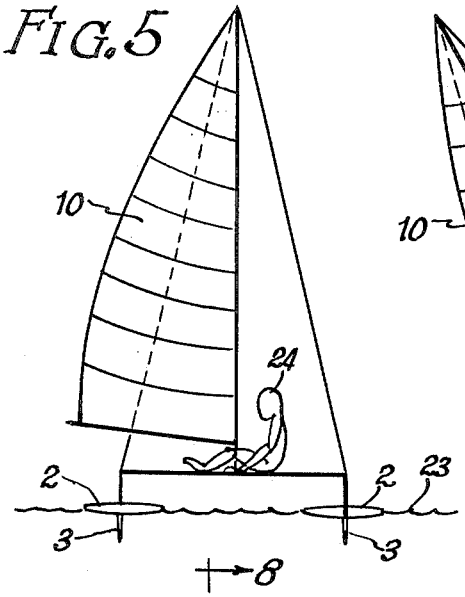
FIG. 5 is a rear view of the craft under way and running with the wind.
Figure 6:
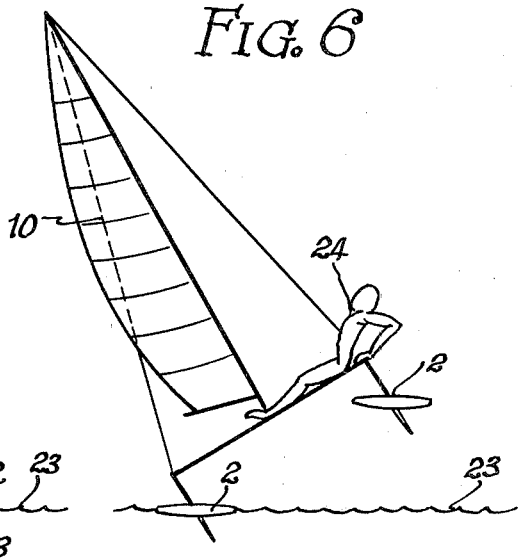
FIG. 6 is a rear view of the craft under way, close hauled, and heeling to wind force. This figure illustrates positioning of the floats relative to one another, heel of the superstructure and level traversal of one float under heel conditions.

Operation is shown in FIGS. 5 and 6. The craft is in the quiescent state, i.e., the floats 2 are lying evenly on the water line 23. A user 24 is resting on trampoline 14 and the sail 10 is extended and running with the wind, that is, the wind is coming from behind the craft. In FIG. 6, sail 10 is closed hauled, causing the craft to heel and one of the floats to ride out of the water. The articulated joints at legs 12, 13 yield to the crafts heel, yet one of floats 2 remains level on the water line and therefore experiences substantially less water resistance compared to that which would be encountered with conventional hulls which heel into the water. Greater speed and maneuverability is thus attained with this technique. The hydrofoil phenomenon is achieved under heel conditions. A lift is caused by the slanted position of rudders 5 in the water while the float remains horizontal. The lift is oblique to the horizontal axis of the floats and causes the craft to ride higher or plane relative to the water line.

Figure 7:
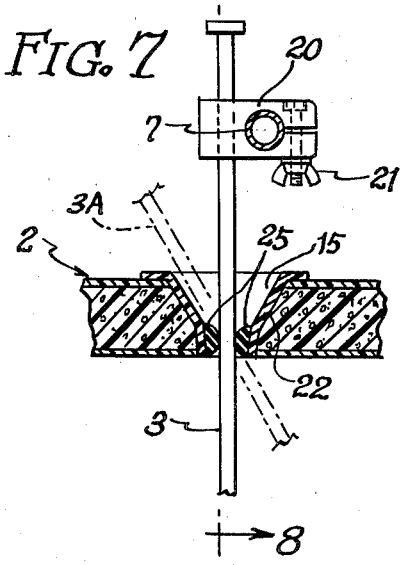
FIG. 7 is a cross-sectional detail of an anti-slippage means and its securing means.
Figure 8:
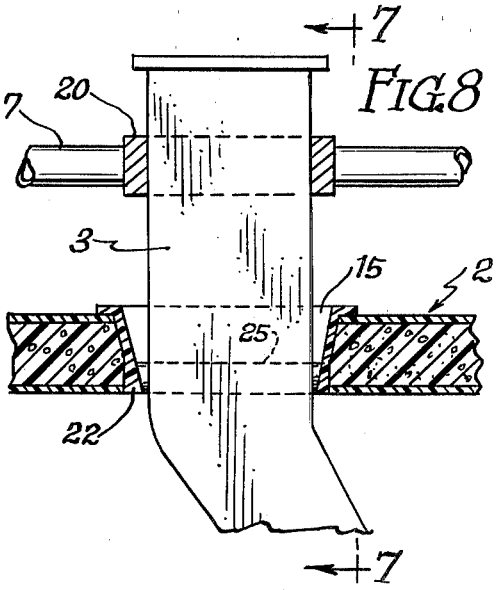
FIG. 8 is yet another cross-section detail of a anti-slippage means passing through a float.

FIG. 7 shows a cross-section of an anti-slippage means and well assembly taken along line 7—7 of FIG. 8, i.e., looking through a fore and aft axis. Anti-slippage means 3 is held steady at its upper end by clamp 20, anti-slippage means 3 shown in phantom passing therethrough. Framework 7 is also captured by clamp 20 and secured by nut and bolt assembly 21. Bushing 22 has nibs 25 which snugly abut lower anti-slippage means 3, but which are resilient enough to allow for rotation of anti-slippage means 3 as shown by phantom anti-slippage means 3A about the axis defined by bushings 18.

FIG. 8 is a section taken along line 8—8 of FIG. 7, or beam axis. Bushing 22 defines the boundaries of well 15 and prohibits fore and aft motion of the anti-slippage means 3. Relative dimensions of framework 7 to clamp 20 (partially shown in phantom) to anti-slippage means 3, are clearly illustrated in this cross-sectional view.

The assembly is relatively fixed, except under heel conditions when anti-slippage means 3 rotates within the boundaries of bushing 22, as shown by phantom anti-slippage means 3A.

While I have described the preferred embodiment of the invention, other embodiments may be devised and different uses may be achieved without departing from the spirit and scope of the appended claims.

What is claimed is:

1. A wind-propelled craft comprising:

at least two elongated, semi-flexible low-profiled and flatbottomed floats;

a framework adapted to support wind propulsion means and at least one user, said floats being distally and parallelly connected by said framework;

on each float, at least two articulated joints each having fore-and-aft rotational axes rotational independently of the joints of the other float, and transverse axes, said joints connecting said framework to the central fore-and-aft line of each of said floats such that said hulls are free to rotate about their fore-and-aft axes in response to changing heel angles of said craft, and free to adjust about the transverse axes in response to pitch flexure of said hulls; and said floats containing openings medially positioned and lined with resilient bushings to house anti-slippage means which move with said framework when same heels such that said anti-slippage means enter the water at the angle of heel of said frame rather than straight, and said resilient bushing permits the non-orthonormal passage of said anti-slippage means through said openings while securing same against loose motion in said openings.

* * * * *